United States Patent [19]

Ebel et al.

[11] 4,097,369

[45] Jun. 27, 1978

[54] PROCESS FOR RECLAIMING USED HYDROCARBON OILS

[75] Inventors: Eckhard Ebel; Hans-Rudolf Kobel; Ernst Widmer, all of Bern, Switzerland

[73] Assignee: Adolf Schmids Erben Aktiengesellschaft, Bern, Switzerland

[21] Appl. No.: 661,857

[22] Filed: Feb. 27, 1976

[30] Foreign Application Priority Data

Feb. 28, 1975 Germany ..... 2508713

[51] Int. Cl.[2] ..... C10M 11/00

[52] U.S. Cl. ..... 208/180; 208/181; 208/182; 208/183; 208/184

[58] Field of Search ..... 208/181–183, 208/180, 262

[56] References Cited

U.S. PATENT DOCUMENTS

| | | | |
|---|---|---|---|
| 1,707,671 | 4/1929 | Aycock et al. | 208/183 |
| 1,869,781 | 8/1932 | Shiffler et al. | 208/262 |
| 1,934,068 | 11/1933 | Jolly et al. | 208/262 |
| 2,328,707 | 9/1943 | Clar et al. | 208/262 |
| 3,773,658 | 11/1973 | Vu et al. | 208/180 |
| 3,819,508 | 6/1974 | Fainman et al. | 208/180 |
| 3,919,076 | 11/1975 | Cutler et al. | 208/180 |

FOREIGN PATENT DOCUMENTS

| | | | |
|---|---|---|---|
| 742,909 | 1/1956 | United Kingdom | 208/183 |
| 1,124,260 | 8/1968 | United Kingdom | 208/183 |

*Primary Examiner*—Herbert Levine

*Attorney, Agent, or Firm*—Oblon, Fisher, Spivak, McClelland & Maier

[57] ABSTRACT

A process for reclaiming used hydrocarbon oils through prepurification by means of coagulation, adsorption, filtration, distillation, and after-treatment, wherein said oils are prepurified and then dehalogenated, fractionally distilled and hydrogenated. It is preferred that for the prepurification, said coagulation and said adsorption are carried out by means of a hydroxide or hydroxide mixture, preferably aluminum and/or ferric hydroxide, in a proportion of 0.5 – 5.0% by weight, preferably 1–2% by weight, of hydroxide relative to said used oil at a reaction temperature of from 20° – 200° C, preferably from 50 to 150° C, said hydroxide or hydroxides being produced directly in said used oil in the presence of water or being introduced into said used oil in the form of an aqueous slurry. It is also preferred that the dehalogenation and accompanying desulfurization are carried out through treatment of said oil with an alkali metal, especially Na or K, an alkaline earth metal, especially Mg or Ca, an alkali, alkaline earth or aliminum alcoholate, an alkali hydride or amide, an organic base, especially pyridine or piperidine, or with metallic aluminum or anhydrous aluminum chloride, in a proportion of the respective treatment agent of from 1 to 2000 moles per metric ton of said oil in the absence of air and humidity at a reaction temperature of from 15° – 300° C.

17 Claims, 1 Drawing Figure

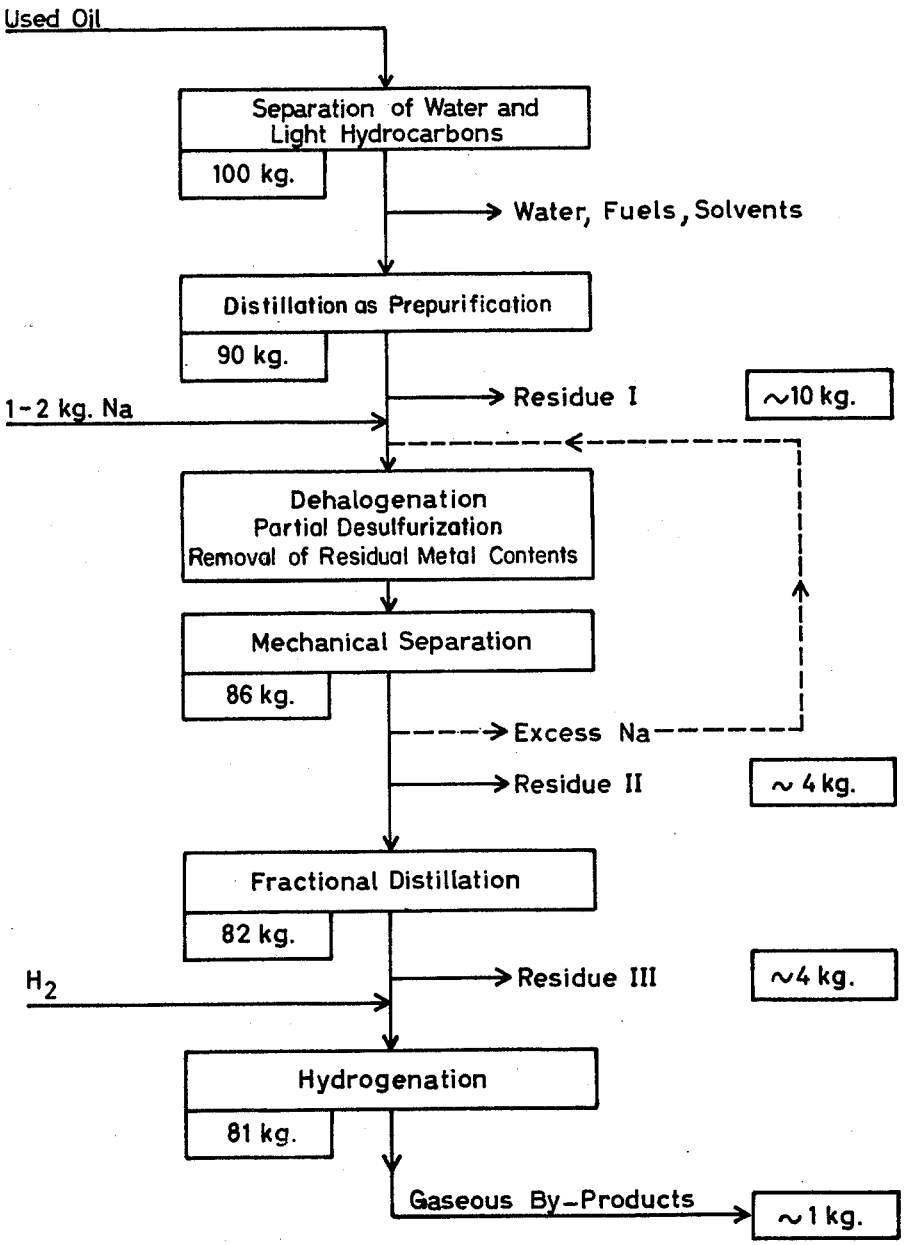
Used Oil
Separation of Water and Light Hydrocarbons
100 kg.
Water, Fuels, Solvents
Distillation as Prepurification
90 kg.
Residue I
~10 kg.
1-2 kg. Na
Dehalogenation
Partial Desulfurization
Removal of Residual Metal Contents
Mechanical Separation
86 kg.
Excess Na
Residue II
~ 4 kg.
Fractional Distillation
82 kg.
Residue III
~4 kg.
$H_2$
Hydrogenation
81 kg.
Gaseous By-Products
~1 kg.

PROCESS FOR RECLAIMING USED HYDROCARBON OILS

This invention relates to a process for reclaiming used hydrocarbon oils through pre-purification by means of coagulation, adsorption, filtration, distillation, and after-treatment.

As used herein and in the claims, the term "hydrocarbon oils" may include motor oil, transmission lubricant, hydraulic oil, turbine oil, cutting oil, hardening oil, heat-transfer oil, and industrial oils. The used oils to be reclaimed may be contaminated by, among other things, water, solvents, dirt, abraded metal, soot, oil carbon, and oxidation and decomposition products of hydrocarbon oils and their additives.

Among the additives of processed hydrocarbon oils are, for instance, viscosity-index improvers, pour-point depressants, anti-oxidants, anti-corrosion additives, high-pressure (EP) and anti-wear additives, bactericides, fungicides, detergents, dispersing agents, emulsifiers, etc. The following elements are to be found in these additives, among others: Ba, Mg, Na, Ca, P, S, Cl, Pb, Zn, Sb, N, Cd, Mo.

The following elements may be found, among others, deriving from the abraded metal: Fe, Cu, Cr, Ni, Al.

The methods currently in use for reclaiming used hydrocarbon oils have numerous drawbacks, the effect of which is, for example, that the oils thus obtained—referred to in the trade as re-refined or secondary refined products—clearly differ qualitatively from the primary refined products as regards a number of analytic data.

Furthermore, with the reclaiming methods applied heretofore, residues are obtained, the processing, dumping, or incineration of which presents numerous new problems. Whereas incineration incurs high expense and is no longer possible in many countries for reasons of environmental protection, dumping of the residues which endanger the ground-water is now permitted only in a very few special pits.

At the present time, the following processes for the reconditioning of used hydrocarbon oils find technical application, among others.

Reconditioning with sulfuric acid:

A mechanical pre-purification of the contaminated oil is followed by separation through distillation of the light hydrocarbons, the solvents, and the water. Thorough separation of the water in particular is absolutely necessary for the next process step.

Concentrated sulfuric acid is thoroughly mixed with the oil in a reaction container. Reaction, precipitation, and extraction of the major part of the contaminants, the consumed, converted, and non-consumed additives then takes place. These materials can be separated from the oil in separators or, more timeconsuming, in settling tanks, and they form the highly-viscous so-called acid tar. Since sulfuric acid in excess is used, the separated oil still contains acid and must be neutralized with alkaline solutions or lime prior to further processing. This step is followed by fractional distillation. The distillates are subjected to bleaching, e.g., hot-contact bleaching, for the purpose of improving their color. As compared with primary refined products, used oil treated in this way may still exhibit numerous negative aspects, such as a marked specific odor, dark color, and a high content of elements foreign to hydrocarbon oils. Particularly because of the content of chlorine or chlorine compounds, virtually unchanged during the course of the process, and the relatively high residual metal content, hydrogenation is practically not possible. Only such an after-treatment would lead to qualities equal to those of primary refined products.

Reconditioning with liquid propane:

The Institut Francais du Pétrole, des Carburants et Lubrifiants has developed a process for regenerating used oil with liquid propane. This method is described in French Pat. No. 1,516,733 and U.S. Pat. No. 3,773,658, among others:

In the first step of the process, water, low-boiling hydrocarbons, and solvents are separated from the used oil by distillation. The heated oil is mixed with liquid propane under pressure. The proportion of oil to propane by weight may amount to from 1:5 to 1:16 and depends upon the contamination of the used oil. The propane acts as a coagulant for the additives and contaminants in the used oil, the amount of propane, the temperature, and the pressure being variable factors for the effectiveness of the precipitation. The separation of liquid propane, oil, and residue may take place in a single step, but also in several stages. Under certain circumstances, an after-treatment with sulfuric acid is necessary for reasons of quality. The purified oil is then subjected to fractional distillation, followed by hot-contact bleaching of the fractions.

For reconditioning with hydrated alkaline-earth oxides, East German Pat. No. 59,356 teaches a method for reconditioning used lubricating oils. The mechanically pre-purified and fuelfree oil is heated and mixed with, preferably, calcium hydroxide and then immediately distilled. The contaminants and additives coagulated by the calcium hydroxide are drawn off as residue in the distillation column. After this treatment, the distillates are supposed to be substantially free of additives. However, a conventional after-treatment of the distillates is necessary. The treatment with sulfuric acid or with lime and bleaching earth, optionally after solvent extraction with furfurol or sulfur dioxide has taken place, may be used for this purpose.

It is an object of this invention to provide a process for reconditioning used oils which eliminates the drawbacks of the prior art methods. At the same time, it is intended that intensive pre-purification of the used oils shall make hydrogenation technically and economically possible. Only in that way are qualities achieved which are comparable to those of modern primary refined products. A further object is to ensure that the resulting residues no longer present costly problems of disposal and pollution as has hitherto been the case with the known processes.

To this end, in the process according to the present invention, the oils are pre-purified and then dehalogenated, fractionally distilled, and hydrogenated.

All liquid products produced on a hydrocarbon-oil basis can be recycled at qualities comparable to those of primary refined products.

The invention will now be described in detail with reference to specific embodiments thereof. First the individual steps for the intensive pre-purification will be set forth.

It has proved possible to precipitate and remove a large proportion of the matter suspended in the used oil by means of coagulation with appropriate agents. It has been found that very good coagulation is achieved with solvents, such as esters, ethers, and ketones of low molecular weight, preferably ethyl acetate (EtAc) and acetone, or mixtures thereof in the ratio of used oil to solvent of from 3:1 to 1:10 by weight. Preferably a ratio of 1:3 is used. The values in Table 1 below illustrate the effectiveness of ethyl acetate as compared with n-heptane, which is non-coagulant in this sense.

Table 1

| Analytical Values / Samples | Used Oil I without pretreatment | Used Oil I pretreated with EtAc | Used Oil II without pretreatment | Used Oil II pretreated with EtAc | Used Oil II pretreated with n-heptane |
|---|---|---|---|---|---|
| Oil: solvent ratio by weight | — | 2:5 | — | 2:5 | 2:5 |
| TBN mg KOH/g ASTM D 2896 | 6.1 | 3.0 | 5.2 | 2.5 | 5.3 |
| Ash % by weight ASTM D 482-63 | 1.26 | 0.51 | 1.16 | 0.44 | 0.84 |
| Appearance of Oil | black, opaque | brown, clear | black, opaque | brown, clear | black, opaque |

In each case, the used oil samples I and II were mixed with the coagulant at room temperature and, after being allowed to stand for 24 hours, were filtered using a filter aid.

The liquids or mixtures thereof listed in Table 2 below also exhibit good coagulating properties. In all cases, the ratio of used oil II to coagulant by weight was 1:2. The conditions were otherwise the same as in the tests with ethyl acetate.

Table 2

| Coagulant / Data | TBN mg KOH/g | Ash % by weight | Appearance of Oil |
|---|---|---|---|
| Butanone | 3.10 | 0.75 | clear, brown |
| 1,4-dioxane | 2.80 | 0.50 | clear, brown |
| Ester mixture[1] | 2.76 | 0.53 | clear, brown |
| Amine mixture[2] | 39.20[4] | 0.61 | cloudy, brown |
| n-Butanol[3] | 2.83 | 0.57 | cloudy, brown |
| Untreated sample | 5.20 | 1.16 | opaque, black |

[1]Mixture of ethyl acetate and methyl acetate in a ratio of 1:1 by volume.
[2]5% n-butyl-diethanol amine and 5% isopropanol by weight in n-hexane.
[3]According to Chemical Engineering, 13 May 1974, the firm of M.Z.F., Los Angeles, California, has developed a process in which aqueous isopropanol is used as an extractant and coagulant. It is also known that Exxon Research Engineering uses $C_4$- and $C_5$-alcohols in laboratory experiments; the results are not known.
[4]The increase in the total base number is attributable to entrained amine.

Further tests have been carried out with 2-methylpentanone-(4), isobutanol, 1,1,1-trichloroethane, benzene chloride, isopropyl acetate, isobutyl acetate, and butyrolactone. These substances, however, did not exhibit good coagulating action.

The monophase ternary system of ethyl acetate/acetone/used oil may be mentioned as an example of the aforementioned mixtures of solvents. Various monophase mixtures from the phase diagram of this system have been tested. Examples of such mixtures yielding good results are shown in Table 3 below. The reaction conditions and recovery are the same as in the tests with ethyl acetate.

Table 3

| Samples / Data | TBN mg KOH/g | Ash % by weight | Appearance of Oil |
|---|---|---|---|
| 24% used oil II by wt. 60% ethyl acetate by wt. 16% acetone by weight | 1.73 | 0.38 | clear, brown |
| 15% used oil II by wt. 59% ethyl acetate by wt. 26% acetone by weight | 1.17 | 0.28 | clear, brown |

Tests analogous to those of Table 3 have also been carried out with good results at an increased reaction temperature, e.g., at 50° C.

It may be taken as certain that in the coagulations with solvents as described, not only are the ash-forming constituents and the solids comprised, but also resin- and asphalt-like products are precipitated out (see, for example, *Abtrennung und Identifikation grenzflächenaktiver Substanzklassen aus Rohölen,* dissertation of H. J. Haardt, Clausthal Technical University, 1973).

Besides coagulation with solvents, good pre-purification has also been achieved through coagulation and/or adsorption by hydroxides of the earth and heavy metals, preferably aluminum hydroxide or ferric hydroxide. The earth, aluminum, or heavy metal hydroxides may be used in an amount of from 0.5 to 5.0%, by weight, of hydroxide relative to said used oil, preferably from 1 to 2% by weight. This treatment may be a temperature of from 20° C. to 200° C., preferably from 50° C. to 150° C. The following chemicals were used for obtaining the hydroxides:

Dispersion I: 175 g. $Ca(OH)_2$ per liter (aqueous)

Dispersion II: 526 g. $Al_2(SO_4)_3.18H_2O$ per liter (aqueous)

Dispersion III: 320 g. $Fe_2(SO_4)_3.2H_2O$ per liter (aqueous)

Assuming the formation of $Al(OH)_3$ and $Fe(OH)_3$, respectively, the equivalent amount for 1 ml. of dispersion I is 1 ml. of dispersion II or dispersion III, respectively. Otherwise, the structure and stoichiometry of the adsorbents were not further investigated.

The tests listed in Table 4 below provide information concerning the effectiveness of aluminum hydroxide as an adsorbent and also concerning the most effective proportions of dispersions I and II. Both agents were added to the used oil and thoroughly mixed at room temperature for 5 min. After being allowed to stand for 20 min., the samples were filtered through filter paper.

Table 4

| Samples / Data | TBN mg KOH/g | T A N* mg KOH/g | Ash % by wt. | pH of Water Extract** | Appearance of Oil |
|---|---|---|---|---|---|
| Used oil II, untreated | 5.2 | 4.7 | 1.16 | — | opaque, black |
| Used oil II, filtered | 5.6 | 2.9 | 1.08 | — | opaque, black |
| 50 ml. used oil II 5 ml. dispersion II 8 ml. dispersion I | 2.4 | 3.1 | 0.74 | 9.4 | clear, brown |
| 50 ml. used oil II 5 ml. dispersion II 6 ml. dispersion I | 2.2 | 4.0 | 0.59 | 8.3 | clear, brown |
| 50 ml. used oil II 5 ml. dispersion II 5 ml. dispersion I | 2.1 | 2.5 | 0.62 | 7.4 | clear, brown |
| 50 ml. used oil II 5 ml. dispersion II | 0 | 2.8 | 0.40 | 6.0 | clear brown |

Table 4-continued

| Samples | Data | TBN mg KOH/g | T A N* mg KOH/g | Ash % by wt. | pH of Water Extract** | Appearance of Oil |
|---|---|---|---|---|---|---|
| 4 ml. dispersion I<br>50 ml. used oil II<br>5 ml. dispersion II<br>2 ml. dispersion I | | 0 | 5.9 | 1.4 | 4.4 | clear, brown |

*Titration with tetramethyl ammonium hydroxide in a mixture of dimethyl sulfoxide and benzene chloride.

**Water extract: 10 ml. of the unfiltered sample shaken with 40 ml. of water.

It clearly follows from Table 4 that the optimum purification effect is obtained with an excess of about 25% by weight of aluminum sulfate. The increase in the values for TAN and oxide ash in the last test indicates that excess aluminum sulfate passed the filter.

The attempt to improve the results still further by choosing other reaction temperatures proved negative.

Table 5 below shows that the results can be further improved by combining the process steps of Tables 1 and 4. After the aluminum hydroxide precipitate had been obtained as described above, the mixture was diluted with ethyl acetate to three times its original volume and stirred again for 5 min. The ethyl acetate was evaporated off, and the sample was filtered through filter paper.

Table 5

| Samples | Data | TBN mg KOH/g | T A N mg KOH/g | Ash % by weight | Appearance of Oil |
|---|---|---|---|---|---|
| Used oil II, filtered | | 5.6 | 2.9 | 1.08 | opaque, black |
| 50 ml. used oil II<br>5 ml. dispersion II<br>3.6 ml. dispersion I | | 0 | 0.44 | 0.41 | clear, brown |
| 50 ml. used oil II<br>5 ml. dispersion II<br>4 ml. dispersion I | | 0 | 0.44 | 0.39 | clear, brown |
| 50 ml. used oil II<br>5 ml. dispersion II<br>4.2 ml. dispersion I | | 0 | 0.29 | 0.38 | clear, brown |
| 50 ml. used oil II<br>5 ml. dispersion II<br>4.4 ml. dispersion I | | 0 | 0.73 | 0.39 | clear, brown |
| 50 ml. used oil II<br>5 ml. dispersion II<br>4.8 ml. dispersion I | | 0 | — | 0.35 | clear, brown |
| 50 ml. used oil II<br>5 ml. dispersion II<br>5.4 ml. dispersion I | | 2.4 | 0.87 | 0.51 | clear, brown |

The values obtained in this manner are move favorable than those given in Tables 1 and 4. It is possible that the values listed in Table 5 may be improved still further by prolonging the duration of action of the acetate up to several hours.

Tests analogous to those combining adsorbent and ethyl acetate were carried out with ferric hydroxide. The results may be seen in Table 6 below.

Table 6

| Samples | Data | TBN mg KOH/g | T A N mg KOH/g | Ash % by weight | Appearance of Oil |
|---|---|---|---|---|---|
| Used oil II, filtered | | 5.6 | 2.9 | 1.08 | opaque, black |
| 50 ml. used oil II<br>5 ml. dispersion I<br>3.9 ml. dispersion III<br>150 ml. ethyl acetate | | 2.0 | 0 | 0.37 | clear, brown |
| 50 ml. used oil II<br>5 ml. dispersion I<br>4.5 ml. dispersion III<br>150 ml. ethyl acetate | | 1.1 | — | 0.26 | clear, brown |
| 50 ml. used oil II<br>5 ml. dispersion I<br>5 ml. dispersion III<br>150 ml. ethyl acetate | | 1.4 | — | 0.32 | clear, brown |

A further series of tests has shown that the residual metal content is further reduced by hot-contact bleaching following the adsorption by ferric hydroxide. The adsorption by ferric hydroxide took place according to the process described in connection with Table 4. Thereafter, bleaching earth and a filter aid were added to the samples, and the mixture was heated to 140° C for 30 min., followed by cooling and filtering.

Table 7

| Sample | Ash, % by weight | Appearance of Oil |
|---|---|---|
| 50 ml. used oil II<br>4 g. bleaching earth<br>2 g. filter aid | 0.30 | clear, light brown |
| 50 ml. used oil II<br>4 g. bleaching earth | 0.28 | clear, light brown |
| 50 ml. used oil II<br>5 ml. dispersion I<br>5.3 ml. dispersion III<br>2 g. bleaching earth<br>0.4 g. filter aid | 0.14 | clear, light brown |
| 50 ml. used oil II<br>5 ml. dispersion I<br>5.3 ml. dispersion III<br>2 g. bleaching earth<br>2 g. filter aid | 0.1 | clear, light brown |
| 50 ml. used oil II<br>5 ml. dispersion I<br>5.3 ml. dispersion III<br>4 g. bleaching earth<br>2 g. filter aid | 0.06 | clear, light brown |

The values show that a relatively high proportion of bleaching earth must be used in order to obtain a very low-ash oil.

Experimentation has indicated that for reasons of economy, optimum results are achieved when the following amounts of adsorbent are not exceeded since larger amounts do not lead to any greater purifying effect:

50 ml. used oil
3.3 ml. dispersion I
3.5 ml. dispersion III i.e., 100 kg. used oil
1.3 kg. calcium hydroxide (as an aqueous dispersion)
2.5 kg. dihydrous ferric sulfate (as an aqueous dispersion)

The numerous coagulation tests carried out show that extensive purification of used oil was achieved using the agents tested. Furthermore, in contrast to the technical processes currently in use, no polluting residues are formed when the abovedescribed coagulation treatments are carried out.

Because of the low ash content, oil pre-purified as described can be directly subjected to fractional distillation. An after-treatment with a very small amount of sulfuric acid and with bleaching earth leads to a secondary refined product of good quality. Since neither the secondary refined products commercially available at present nor the oil obtained after the treatments described above comes up to the quality standards of today's modern primary refined products, after-treatment tests have been carried out.

In the present state of the art, hydrogenation represents the most convenient and most economical process of aftertreatment; therefore, the further work undertaken concentrated on making this after-treatment applicable to pre-purified used oils. Tests have shown that a relatively high residual metal content and, above all, the virtually unchanged proportion of halogen compounds remaining after the processes described above, make hydrogenation technically and economically impossible. These facts called for an additional process step for the purpose of removing the remaining foreign matter.

It has been found that through treatment with the agents listed below, a reduction of the disturbing foreign matter, in some cases a substantial reduction, can be achieved:

alkali metal, especially Na or K; alkaline-earth metal, especially Mg or Ca; alkali, alkaline-earth, or aluminum alcoholate; alkali hydride or amide; an organic base, especially pyridine or piperidine; or metallic aluminum or anhydrous aluminum chloride. These treating agents may be used in the proportion of from 1 to 2000 moles of treating agent per metric ton of used oil in the absence of air and humidity and at a reaction temperature of from 15° C. to 300° C.

Investigations have shown that the combined-chlorine content in used oils from various western European countries may vary between 500 and 5000 ppm (parts by weight per million parts by weight) and is only inappreciably reduced by means of the usual reconditioning processes.

The investigations to be described below relate to a used oil III having a chlorine content of 1180 ppm. This oil was subjected to vacuum-distillation for the pre-purification.

In order for hydrogenation to be carried out in a technically and economically feasible manner, the chlorine content should not exceed 5 ppm according to the consensus of those skilled in the art (cf. *Die Verarbeitung des Erdöls,* by Bruno Riediger, Springer-Verlag, Berlin-Heidelberg-New York, 1971, pp. 692ff.).

The following tables indicate that the aforementioned agents bring about an albeit differing reduction of the chlorine content under variable conditions.

Table 9

Effect of the Alkali Metals on the Chlorine Content

| Test No. | Equipment | Agent | Conc. Agent mmole/ 100 g. oil | Recovery | Reaction Time min. | Reaction Temp. ° C | Cl Content ppm | Remarks |
|---|---|---|---|---|---|---|---|---|
| 1.11 | N[9] | Na | 100 | WA[11] | 30 | 110 | 157 | |
| 1.12 | N | Na | 100 | WA | 30 | 150 | 100 | |
| 1.13 | N | Na | 100 | WA | 30 | 200 | 60 | |
| 1.14 | N | Na | 100 | WA | 5 | 250 | 9 | |
| 1.15 | N | Na | 100 | WA | 30 | 250 | 7 | |
| 1.16 | N | Na | 100 | WA | 30 | 300 | <5 | Decomposition of Oil |
| 1.17 | D[10] | Na | 100 | DIST[12] | 2 | 250 | 9 | |
| 1.18 | D | Na | 100 | DIST | 10 | 250 | <5 | |
| 1.19 | D | Na | 100 | WA | 10 | 250 | <5 | |
| 1.20 | D | Na | 20 | WA | 5 | 250 | 7 | |
| 1.21 | D | Na | 10 | WA | 5 | 250 | 230 | |
| 1.210 | N | K | 100 | WA | 30 | 200 | <5 | |
| 1.220 | N | K | 100 | WA | 30 | 250 | <5 | |

[9]Sulfonating flask, $N_2$ bubbler, laboratory stirrer

[10]Sulfonating flask, $N_2$ bubbler, dispersing apparatus (25,000 rpm, 2 cm. $\phi$)

[11]Excess agent destroyed with water, oil washed with dilute sulfuric acid, then washed several times with water, dried, and filtered

[12]Excess agent allowed to settle, oil decanted off and vacuum-distilled

As may be seen from Table 9, the reaction temperature should be about 250° C in order to reach the desired reduced chlorine content of maximum 5 ppm.

The dependence upon reaction time and concentration of the alkalis may also be seen from Table 9. It is worthy of note that with the extremely small amount of 20 millimoles of Na per 100 g. of oil (corresponding to 4.6 kg. of Na per 1000 kg. of oil), sufficient dechlorination can be achieved in an extraordinarily economical manner.

Moreover, the treatment with sodium brings about a 50% reduction of the sulfur content in the oil.

Another substantial advantage of this treatment is that viscosity-index improvers of the polymethacrylate type can no longer be detected in the distillates. When distillation takes place without the sodium pre-treatment, about 50% of the original amount of viscosity-index correctives are still contained in the distillates.

Table 10

Effect of Alcoholates on the Chlorine Content

| Test No. | Equipment | Agent | Conc. Agent mmole/ 100 g. oil | Recovery | Reaction Time min | Reaction Temp. ° C | Cl Content ppm |
|---|---|---|---|---|---|---|---|
| 2.1 | N[9] | sodium ethylate | 200 | WA[11] | 150 | 200 | 110 |
| 5.1 | N | Al isopropylate | 100 | WA | 30 | 200 | 1050 |
| 5.2 | N | Al isopropylate | 100 | WA | 30 | 250 | 100 |

Table 11

| Test No. | Equipment | Agent | Conc. Agent mmole/100 g. oil | Recovery | Reaction Time min. | Reaction Temp. ° C | Cl-Content ppm | Remarks |
|---|---|---|---|---|---|---|---|---|
| Effect of Alkali Hydrides on the Chlorine Content | | | | | | | | |
| 8.1 | N[9] | NaH | 100 | WA[11] | 30 | 150 | 170 | |
| 8.2 | N | NaH | 100 | WA | 30 | 200 | 100 | |
| 8.3 | N | NaH | 100 | WA | 30 | 250 | <5 | |
| 8.4 | N | NaH | 100 | WA | 20 | 300 | <5 | Decomposition of Oil |

As may be seen from Table 11, here, too, the reduction of the chlorine content is highly dependent upon the reaction temperature.

Other tests, not listed here, have shown that reductions in the amount of sodium hydride and in the reaction time are possible with adequate dechlorination. Furthermore, the sodium hydride treatment has the effect of reducing the sulfur content of the starting material by about 90%.

Table 12

| Test No. | Equipment | Agent | Conc. Agent mmole/100 g. oil | Recovery | Reaction Time min. | Reaction Temp. ° C | Cl Content ppm | Remarks |
|---|---|---|---|---|---|---|---|---|
| Effect of Anhydrous Aluminum Chloride on the Chlorine Content | | | | | | | | |
| 6.1 | N[9] | $AlCl_3$ | 40 | WA[11] | 30 | 100 | 760 | relatively light-colored |
| 6.2 | N | $AlCl_3$ | 55 | WA | 30 | 100 | 570 | relatively light-colored |
| 6.3 | N | $AlCl_3$ | 40 | WA | 30 | 150 | 460 | relatively light-colored |
| 6.4 | N | $AlCl_3$ | 55 | WA | 30 | 150 | 220 | relatively light-colored |
| 6.5 | N | $AlCl_3$ | 80 | WA | 180 | 150 | 50 | relatively light-colored |

Table 13

| Test No. | Equipment | Agent | Conc. Agent mmole 100 g. oil | Recovery | Reaction Time min. | Cl Reaction Temp. ° C | Content ppm | Remarks |
|---|---|---|---|---|---|---|---|---|
| Effect of Other Agents on the Chlorine Content | | | | | | | | |
| 7.1 | PR[13] | Pyridine | 400 | WA[11] | 120 | 200 | 730 | app. 8 atm gauge pressure |
| 7.2 | PR | Piperidine | 400 | WA | 120 | 200 | 130 | app. 8 atm gauge pressure |
| 3.1 | N[9] | Mg | 400 | WA | 150 | 200 | 730 | |
| 9.1 | N | $NaNH_2$ | 7 | WA | 30 | 150 | 910 | |
| 9.2 | N | $NaNH_2$ | 7 | WA | 30 | 250 | 260 | |

[13]Pressure vessel, no stirrer

Table 14

| Specifications | Used oil III not dist. | Used oil III dist. | Test 1.15 (Tab. 9) | Test 6.4 (Tab. 12) | Comm. Avail. Neutral Oil | Comm. Avail. Second. Refined Product |
|---|---|---|---|---|---|---|
| Data Comparisons of Various Oils | | | | | | |
| Color ASTM D 1500 | — | 3.5 | >8 | 3.5 | 1 | 3.5 |
| Density 20° C | — | 0.882 | 0.882 | 0.851 | 0.875 | 0.880 |
| Viscosity cSt 50° C | 44.3 | 28.1 | 34.0 | 30.0 | 38.0 | 47.0 |
| Viscosity cSt 37.8° C | — | 47.9 | 57.7 | 51.2 | 68.0 | 85.0 |
| Viscosity cSt 99° C | — | 6.9 | 7.3 | 6.9 | 8.1 | 9.5 |
| $VI_E$ ASTM D 2270-64 | — | 107 | 93 | 98 | 95 | 100 |
| Ash % by weight | 0.47 | 0.007 | 0.003 | 0.009 | 0 | <0.02 |
| CCT ASTM D 189-65 | 1.09 | 0.14 | 0.15 | 0.10 | 0.05 | 0.10 |
| Aniline Point ° C | — | 100 | — | 102 | 107 | 105 |
| Acid Number mg KOH/g | 1.01 | 0.33 | <0.03 | 0.12 | <0.03 | <0.10 |
| Saponification No. mg KOH/g | — | 1.85 | 0.5 | — | — | 8.2 |
| Iodine Number g $I_2$/100 g | — | 3.17 | 9.5 | — | 4.5 | 8.5 |
| Copper Strip Test | | | | | | |

Table 14-continued

| Specifications | Data Comparisons of Various Oils | | | | | |
|---|---|---|---|---|---|---|
| | Used oil III not dist. | Used oil III dist. | Test 1.15 (Tab. 9) | Test 6.4 (Tab. 12) | Comm. Avail. Neutral Oil | Comm. Avail. Second. Refined Product |
| 100° C / 3 hr. ASTM D 130-68 | — | 2 | 1 | 1 | 1 | 1 |
| S Content % by weight | 1.03 | 0.77 | 0.40 | — | 0.11 | 0.6 |
| Cl Content ppm | 1400 | 1180 | 7 | 220 | <5 | 400 |
| TBN ASTM D-2896 | — | 0.3 | 0.2 | — | 0.1 | 0.05 |

A preferred embodiment of the invention will now be described in detail with reference to the accompanying drawing, which is a flow sheet.

As a pre-treatment, the used oil, free of coarse, solid contaminants, is rid of water, solvents, and light hydrocarbons by distillation according to known methods, then further distilled in vacuo until a residue I of about 10% by weight remains. The resulting residue I is, at room temperature, a highly-viscous oil which can then be combusted.

The distillate is treated with 1–2 kg. of metallic sodium, for example, to remove the halogen compounds, residual metals, and part of the sulfur compounds. This treatment must be carried out in the total absence of air and humidity and with thorough mixing at a temperature of about 250° C.

In the next process step, excess sodium and the reaction products are separated by mechanical means, e.g., by centrifuging. The excess sodium may be recycled. The separated reaction products (residue II) are also combusted.

The separated oil is fractionally distilled in vacuo. Residue III is combusted.

The individual fractions are subjected to catalytic hydrogenation as an after-treatment.

The yield of refined product recovered according to the invented process amounts to about 81% by weight relative to used oil free of water and light hydrocarbons.

What is claimed is:

1. In a process of reclaiming used hydrocarbon oils from which water and light hydrocarbons have been removed by distillation and wherein the oils are prepurified either by coagulation, adsorption, a combination of coagulation and adsorption, by filtration, or by vacuum distillation, with subsequent fractional distillation and after-treatment, the improvement which comprises subjecting the prepurified product to dehalogenation, partial desulfurization, and removal of residual metal contents prior to the fractional distillation and after-treatment by contacting said prepurified oil with an agent selected from the group consisting of alkali metals and alkali metal hydrides.

2. The process of claim 1, wherein the prepurification is by coagulation with a solvent selected from the group consisting of low molecular weight esters, ethers, ketones, and mixtures thereof, in the ratio of used oil to solvent of from 3:1 to 1:10 by weight.

3. The process of claim 2, wherein the solvent is selected from the group consisting of ethyl acetate, acetone, and mixtures thereof.

4. The process of claim 2, wherein the ratio of used oil to solvent is 1:3 by weight.

5. The process of claim 1, wherein the adsorption step is carried out with an agent selected from the group consisting of an alkaline earth or heavy metal hydroxide or a mixture thereof in the proportion of from 0.5%–5.0% by weight of hydroxide relative to said used oil and at a temperature of from 20° C to 200° C.

6. The process of claim 5, wherein the proportion of hydroxide relative to the used oil is from 1% to 2% by weight.

7. The process of claim 5, wherein the adsorption step is carried out at a temperature of from 50° C to 150° C.

8. The process of claim 5, wherein the hydroxide is selected from the group consisting of calcium hydroxide, aluminum hydroxide, ferric hydroxide, and mixtures thereof.

9. The process of claim 1, wherein the step of dehalogenation, partial desulfurization, and removal of residual metal contents is carried out by contact with from 1 to 2000 moles of the treating agent per metric ton of oil, in the absence of air and humidity and at a temperature of from 15° to 300° C.

10. The process of claim 9, wherein the treating agent is selected from the group consisting of sodium and potassium.

11. The process of claim 10 wherein the temperature of treatment is about 250° C.

12. The process of claim 1, wherein the after-treatment is catalytic hydrogenation.

13. In a process of reclaiming used hydrocarbon oils from which water and light hydrocarbons have been removed by distillation and wherein the oils are prepurified either by coagulation, adsorption, a combination of coagulation and adsorption, by filtration, or by vacuum distillation, with subsequent fractional distillation and after-treatment, the improvement which comprises subjecting the prepurified product to dehalogenation prior to the fractional distillation and after-treatment by contacting said prepurified oil with an agent selected from the group consisting of alkaline earth metals, alkali metal alcoholates, alkaline earth metal alcoholates, aluminum alcoholates, alkali metal amides, pyridine, piperidine, metallic aluminum and anhydrous aluminum chloride.

14. The process of claim 13 wherein the dehalogenation step is carried out by contact with from 1 to 2000 moles of the treating agent per metric ton of oil, in the absence of air and humidity and at a temperature of from 15° to 300° C.

15. The process of claim 13, wherein the after-treatment is catalytic hydrogenation.

16. The process of claim 13, wherein the treating agent is selected from the group consisting of magnesium and calcium.

17. The process of claim 13, wherein the treating agent is selected from the group consisting of pyridine and piperidine.

* * * * *